US005403540A

United States Patent [19]

Brundage et al.

[11] Patent Number: 5,403,540

[45] Date of Patent: Apr. 4, 1995

[54] HEATING OF FORMED METAL STRUCTURE BY INDUCTION

[75] Inventors: Kevin R. Brundage, Corning; David L. Hickman, Horseheads; David F. Thompson, Painted Post, all of N.Y.

[73] Assignee: Corning Incorporated, Corning, N.Y.

[21] Appl. No.: 604,201

[22] Filed: Oct. 29, 1990

[51] Int. Cl.[6] ..... F26B 3/347

[52] U.S. Cl. ..... 419/2; 419/28; 419/36; 419/37; 419/38; 419/41; 419/48; 419/52; 219/602; 219/603; 219/635; 34/247; 432/8; 432/266

[58] Field of Search ..... 419/52, 41, 36, 37, 419/53, 54, 2, 38, 48; 219/602, 603, 635; 34/247; 432/8, 266

[56] References Cited

U.S. PATENT DOCUMENTS

| | | | |
|---|---|---|---|
| 3,630,727 | 12/1971 | Rossmann | 75/214 |
| 3,708,645 | 1/1973 | Osborn, Jr. | 219/10.41 |
| 3,731,050 | 5/1973 | Latour | 219/149 |
| 3,762,014 | 10/1973 | Klein | 29/203 |
| 3,778,586 | 12/1973 | Brenton et al. | 219/76 |
| 3,779,747 | 12/1973 | Conta | 75/200 |
| 3,848,331 | 11/1974 | Pavlik et al. | 29/596 |
| 3,894,892 | 7/1975 | Conta | 148/108 |
| 4,006,016 | 2/1977 | Zambrow et al. | 75/221 |
| 4,038,738 | 8/1977 | Fischmeister et al. | 29/420.5 |
| 4,380,473 | 4/1983 | Lichtinghagen | 419/41 |
| 4,414,028 | 11/1983 | Inoue | 419/31 |
| 4,582,677 | 4/1986 | Sugino et al. | 419/2 |
| 4,704,252 | 11/1987 | Pfaffman | 419/49 |
| 4,871,621 | 10/1989 | Bagley et al. | 428/549 |
| 4,992,233 | 2/1991 | Swaroop et al. | 419/2 |

*Primary Examiner*—Donald P. Walsh
*Assistant Examiner*—Daniel Jenkins
*Attorney, Agent, or Firm*—Angela N. Nwaneri

[57] ABSTRACT

A method is presented for uniformly heating plastically deformable material, which comprises particles of electrically conducting matter. This method comprises inducing an electric current, or causing hysteresis loss within such material, by using electromagnetic radiation with frequency between about 50 Hertz and about 10 MegaHertz, to cause heating of the material.

21 Claims, 1 Drawing Sheet

HEATING OF FORMED METAL STRUCTURE BY INDUCTION

BACKGROUND

This invention relates to a method for uniformly heating plastically deformable material, which comprises electrically conductive particulate matter, by induction heating. Induction heating is accomplished by placing the plastically deformable material in proximity with an induction device through which an electric current of appropriate frequency is passed, thus causing induction of an electric current or hysteresis loss within the material. Induction of such an electric current or causing of hysteresis loss within the electrically conducting particulate matter of the plastically deformable material generates heat thereby causing uniform heating of the plastically deformable material.

This heat generation causes the plastically deformable material to heat uniformly which leads to stiffening, or rigidification of formed plastically deformable material at least to the point that it is capable of being easily handled without ready deformation resulting from the handling. The observed stiffening probably results from the heating causing either gelation of a thermally gelling component of the material, at least partial drying or solidification, or a combination of the two actions. With continued induced heating it should be possible to cause full curing of binders, burnout of the binders and, finally, sintering of the formed article.

Induction heating is a recognized method for causing surface heating of objects or materials and has been used for metal melting, welding, and bonding. Induction heating has not been recognized as a method for even heating of objects. Such even heating is an important aspect of the practice of this present invention. An example of the use of induction heating is found in U.S. Pat. No. 3,352,951 issued to Sara Nov. 14, 1967. Sara teaches a method for providing high density refractory carbide articles by forming carbide material, without liquid or binder, to a desired shape and encapsulating the article within electrically conductive material (a "receptor"), which must have a higher melting point than the material within the receptor. The encapsulated article is then sintered at a temperature just below the melting point of the material itself. The sintering occurs under an inert atmosphere and is accomplished by inductive heating of the electrically conductive capsule which surrounds the formed carbide article. Induction heating has not, however, been known to be used to create a rigid formed green or unfired body shaped of particulate electrically conductive material mixed with plasticizing ingredients such as organic binder and a liquid, of which the former may be gelled and from which the latter is volatilized to produce stiffening and drying of such mixture.

SUMMARY OF THE INVENTION

The present invention provides for a method of stiffening or drying plastically deformable material, which comprises particulate electrically conductive matter, by induction heating. Additionally, this method may be used to accomplish curing of the plastically deformable material, burnout of volatile components, or sintering of particulate electrically conductive matter. In particular, the invention is a method of uniformly heating plastically deformable material, which comprises particles of electrically conducting matter, comprising; inducing an electric current within said material, by using electromagnetic radiation with frequency between about 50 Hertz and about 10 MegaHertz, to cause induction heating of the material.

"Stiffening" in this description is intended to describe any rigidification such that articles formed of the plastically deformable material are deformed less easily than they would have been without having been subjected to treatment through the method described. Such stiffening provides processing advantages by making formed parts less subject to damage by sagging and/or deformation through handling, and, especially, it allows formation of firmly self-supporting articles with extremely thin walls, particularly those of less than 0.008 inch (0.20 mm) thickness, and, more preferably, those of less than 0.005 inch (0.13 mm). Such articles are difficult, if not impossible to form without the use of this invention.

"Drying" throughout this description is intended to describe the removal of any fluids from the formed plastically deformable material.

"Curing" is intended to describe any setting effect occurring through rearrangement, on a minute physical level, of any component of the plastically deformable material and includes, but is not limited to: breaking of binder emulsions and polymerization or cross-linking of binders.

"Burnout" throughout this description is intended to describe the removal by oxidation, decomposition, or other volatilization of any normally solid or low vapor pressure components of the plastically deformable material.

"Sintering" carries its traditional meaning including, but not limited to, joining of individual particles, partial densification, and consolidation of formed articles.

Gaining the ability to form articles with thin walls is the primary goal of this invention, but it also works well to aid in enhancing the formation and ease of handling of thick-walled articles. Articles having walls which need to be self-supporting include, but are not limited to, tubing, cups, and honeycomb structures. It is desirable to form honeycomb structures, for example, with thin walls for several reasons. When such structures are placed in the exhaust stream of internal combustion engines, as part of a catalytic converter to support the catalysts which decompose harmful and undesirable exhaust gasses, the honeycomb needs to reach an elevated temperature before the intended catalysis will occur. The structure also needs to provide the least possible resistance, or backpressure, for the exhaust gas stream so as to avoid inhibiting engine performance. Therefore, ideally, the honeycomb should have minimal mass to facilitate rapid heating, on engine start-up, to initiate catalytic action. It should also present a minimal transverse cross sectional area to the exhaust stream to minimize backpressure. Forming articles such as honeycombs with extremely thin walls serves both goals of mass and solid cross sectional area reduction well and enhances the catalytic converter function.

Problems of self-support arise in making such objects or articles, and are particularly acute when they are formed with very thin walls. Formation of such thin walls requires that the forming member, which actually forms the plastically deformable material into a useful object, must comprise very narrow forming passages or slots. The ability to force the material through such slots is dependent upon the material being readily deformable under pressure and having low viscosity.

These very material properties which make formation of thin walls possible are the culprits which cause difficulties after formation. Such plastically deformable, low viscosity materials will tend to sag, collapse, and even pull apart quickly after formation. A rough approximation of the consistency of materials needed may be imagined when one thinks of forming wet tissue paper; it simply is not self-supporting at all.

Use of the present invention allows the plastically deformable material to be stiffened to the point of being self-supporting, and beyond to being capable of being handled easily either immediately after formation or as it is being formed. Use of this invention is particularly advantageous when used with plastically deformable material systems which comprise electrically conductive particulate matter which is mixed with liquid as a plasticizer.

Often when a green or unfired object or body has been made from plastically deformable material comprising particulate matter, there has been application of radiant and/or convective heat to dry, or cause rigidification of, the body to cause it to become self-supporting. Such application of heat to an article formed of plastically deformable material may be disadvantageous since it is difficult to distribute the heat quickly and evenly throughout the body. Slow heating leaves the forming process with the same problem of sagging, collapsing articles. Differential heating, across the body, may lead to problems such as differential shrinkage, skin formation in the immediate vicinity of the applied heat which in turn leads to various surface defects such as cracks, fissures, or checks. Differential heating may also cause deformation of the formed body by developing opposing compression and tension forces, the tension forces being developed by faster shrinkage of the outside of a formed body.

Other researchers at Corning Incorporated have found another method for stiffening plastically deformable material involving application of radio frequency energy to a formed article. This method is useful for stiffening similar materials in that heat is generated within the body itself which causes enough stiffening to allow the bodies to be handled in a reasonable fashion. Application of radio frequency energy, however, is likely to cause severe problems when applied to bodies comprising electrically conductive, particularly metallic, materials. Application of radio frequency energy to such deformable material comprising metallic matter offers some benefits in the form of a more rigid or stiffened body but moderate or long exposure to such radio frequency energy is likely to destroy the body. A body formed from particulate metal-containing material and subjected to radio frequency energy tends to be pyrophoric, particularly when very small particles of metal are used in the material since the small particles are more prone to rapid oxidation. Exposure to radio frequency energy, for more than a few seconds, appears to lead to preferential edge heating of the formed body which is then followed by rapid oxidation and likely ignition of the material. Thus, exposure of metal particle containing formed bodies to RF energy is likely to cause severe burning unless the time of exposure is limited by a time consuming and impractical process of sequential on-off operation of the RF device. This is in direct contrast to the uniform heating of the present invention.

A major difference between the present invention and the previously mentioned method using radio frequency energy is that, while not wishing to be bound by theory, the present invention appears to induce heating of the body by raising the energy level of the free electrons in the electrically conductive particles comprising the plastically deformable material, while the use of radio frequency energy raises the energy level of polar molecules within the material, thereby generating the necessary heat to provide the stiffening effect which is noted with a rise in temperature of the described material. The method of the present invention, however, is able to be used not only to stiffen, but also to thoroughly dry, cure, burnout, or sinter bodies formed from plastically deformable material which comprise electrically conductive particulate matter. The heating accomplished by induction, as in the present invention, is functional and more controllable when electrically conductive particles are present. Further, use of induction heating avoids the problem of the apparent preferential edge heating coupled with the creation of incendiary formed bodies which is noted in RF heating.

The inventive method is inherently flexible enough to allow induction heating to be performed, to initiate stiffening or drying, while said plastically deformable material is contained within or passing through a forming member, such as a die for extruding such material, to form a green or unfired body. Induced heating may also be used for curing of components of the plastically deformable material, for burnout of the formed article, and to sinter the formed article. It is noted, however, that the inventive method when applied to the newly shaped plastically deformed material within the forming member or immediately as it emerges from a forming member, allows the manufacture of objects, bodies, or articles which are particularly difficult to form. This is especially true for articles having particularly thin (less than 0.008 inch or 0.20 mm) walls, which tend not to be wholly self-supporting due to the inherently inadequate wet strength of the thin walls. The inventive method, while not limited to extrusion in the shaping of plastically deformable material comprising electrically conductive particles, is particularly well suited for adaptation to the extrusion of such plastically deformable material. In this situation, the electronic activity, or excitation of electrons, may be induced in the electrically conductive matter contained within the plastically deformable material, thereby causing an elevation in temperature of the entire formed body or article. The elevation of temperature, which occurs rapidly on exposure to electromagnetic energy within the specified frequency range as applied through an induction device, first causes a noticeable and uniform stiffening of the extrudate followed by thorough drying as application of the energy is continued. It will be readily apparent to those skilled in the art that such a method of rapid stiffening of formed plastically deformable material containing electrically conductive matter will be particularly advantageous not only in extrusion processes but will also find utility in other processes including, but not limited to molding, pressing, or stamping.

DETAILED DESCRIPTION OF PREFERRED EMBODIMENTS

Figure 1:
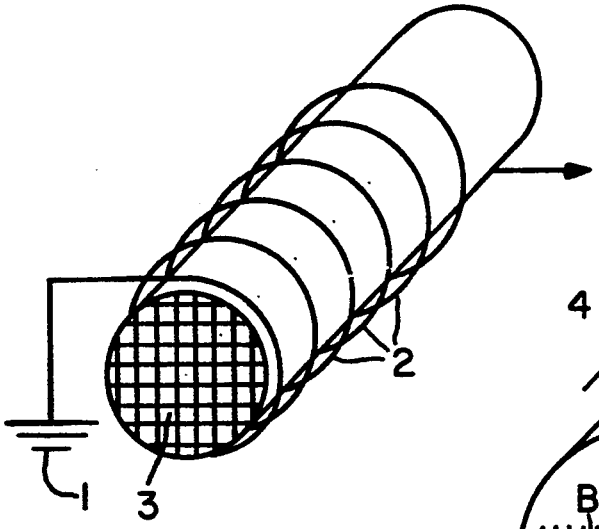
FIG. 1 is a schematic view of a formed article within an induction device.

In a preferred embodiment of this invention an induction heating means is placed at the exit of the forming member of an extrusion apparatus. The previously described plastically deformable material comprising electrically conductive matter is then placed in the extrusion apparatus and processed according to typical extrusion processing methods, see for example U.S. Pat. No. 4,758,272, which is incorporated by reference herein. While the inventors do not wish to be bound by theory, it appears that the inventive aspect here is that as the plastically deformable material is contained in or exits the forming member, electronic and/or magnetic activity is induced within the electrically conductive matter which comprises the plastically deformable material. As the electronic activity is induced within the material, the temperature of the plastically deformable material increases, thus uniformly raising the temperature of the extrudate.

Another preferred embodiment of this invention involves the extrusion of plastically deformable material comprising electrically conductive matter into a "honeycomb" type structure. The honeycomb is defined by intersecting walls surrounding open, elongated cells extending longitudinally through the formed body. When formed into such a structure, said plastically deformable material, upon final sintering, forms an article which is particularly well suited for use as a catalyst-bearing substrate or porous particulate filter. The catalyst-bearing substrate may be placed within a fluid stream in which it is desired to catalytically convert components of the stream to a different composition. The present invention is particularly well suited to being used with the process of extruding honeycomb type structures (such as is disclosed in U.S. Pat. No. 3,790,654, which is incorporated by reference herein) since the as extruded honeycomb body has generally low wet strength, particularly when extremely thin, 0.008 inch (0.20 mm), and desirably less than 0.005 inch (0.13 mm) inch thickness, internal walls are formed. Such a structure generally is not wholly self-supporting thus making it subject to damage through sagging and/or handling deformation of the extruded body. Such deformation of the extruded wet honeycomb structure is particularly likely when the internal walls of the honeycomb structure are very thin.

The generally uniform generation of heat throughout the entire cross-section of the extruded honeycomb structure extending through the length of the structure which is in proximity to the induction device appears to either dry the extruded body through relatively uniform evaporation of water, gel a polymeric thickener (when present), or accomplish a combination of both. The inventors do not wish to be bound by theory but the three preceding possibilities are offered as potential explanations for the reality of the stiffening of the extruded body when placed in proximity to an induction device to effect the desired heating. It will be apparent to those familiar with the art that the advantages of the present invention, which serves to uniformly heat plastically deformable material to cause stiffening, include: (1) reduction of sagging or handling deformation through lack of adequate wet green strength, (2) reduction of surface defects, which in the past have been generally caused by non-uniform drying through the application of heat, and (3) the ability to produce bodies, particularly honeycomb-type structures, with much thinner walls which become self-supporting through the immediate stiffening, or drying step provided by the inventive method.

EXAMPLES

Unless otherwise specified, plastically deformable material comprising metal particles which was used for the following examples was prepared as follows:

| Material | Supplier | Weight |
|---|---|---|
| Fe/50 Al powder (screened −400 mesh) | Shieldalloy | 23 lbs. (10.45 kg) |
| Oleic Acid (reagent grade) | Mallinckrodt | 0.5 lbs. (.23 kg) |
| Methyl Cellulose | Dow Chemical | 3 lbs. (1.36 kg) |
| Iron Powder (carbonyl OM) | BASF | 27 lbs. (12.27 kg) |

The above components were mixed for five minutes under an argon blanket in a Littleford mixer. Since finely divided metal powders are highly flammable, argon was used as an inert gas blanket in the mixture to prevent oxygen intrusion. After mixing, the batch was wrapped in plastic and chilled overnight in a refrigerator. A quantity of deionized water was also chilled over night in a separate container. Using a medium-sized, chilled Simpson mix-muller, 7.1 lbs. (3.23 kg) of water was added over a two minute mulling period to the previously described chilled batch. Upon completion of the addition of the chilled deionized water, the mix-muller was run for an additional two minutes. The resulting plastically deformable material was then checked for its suitability for extrusion in a ram type extruder by one who is skilled in the art of extrusion. If additional water was required, in small amounts, to reach the desired extrusion consistency, the mix-muller was then run for two minutes after each additional aliquot of water. The mix-muller was then run for an additional five minute period after the final addition of water. Again, for safety reasons, the mix-muller was operated under a blanket of argon to prevent oxygen intrusion. The batch was then transferred in plastic bags to a ram type extruder which was fitted with a "spaghetti making die". The batch was fed into the extruder barrel and the barrel was brought down to form a seal. The exit end of the extruder was sealed with a rubber stopper such that the barrel could be evacuated. A vacuum was established for two minutes after which the ram was slowly advanced compacting the plastically deformable material and extruding it through a multi-orifice die so as to turn it into densely packed wet "spaghetti". After all of the "spaghetti" had been formed, the multi-orifice die was changed and replaced with one designed to produce a three inch (7.6 cm) diameter honeycomb with 0.003" (0.76 mm) internal walls and 550 cells per square inch (about 85 per $cm^2$) in a transverse cross section. The extruder barrel was loaded with the formed "spaghetti" and the ram was advanced slowly until two to three feet of formed plastically deformable material in honeycomb shape was outside the extruder. All extrusions were conducted vertically. The honeycomb shaped plastically deformable material was carefully supported and cut into 4–6 inch (10–16 cm)

lengths. These short pieces were then placed in 500 ml beakers in an ice chest containing dry ice for between three and four hours. The hard frozen pieces were then carefully wrapped in aluminum foil and placed in a freezer at −10° C. to be transported to an off-site laboratory having induction heating facilities.

During transport to the off-site laboratory the honeycombed shaped pieces of plastically deformable material were kept in an ice chest with dry ice. The solidly frozen pieces of material were then placed inside an induction heating coil with a 4 inch (10 cm) inside diameter, an overall length of 5 inches (13 cm), and a total of eight turns. This induction heating coil is represented in FIG. 1 where electric current from source (1) is conducted through the coils (2) to induce a current or cause hysteresis loss, and thereby cause heating, in a formed article (3). Temperature measurements were made at five different points of a transverse section of the formed material. These measurements were taken with a K-type thermocouple. Movement of the thermocouple along the longitudinal axis of the test pieces did not reveal any gross thermal gradients along that axis.

Figure 2:
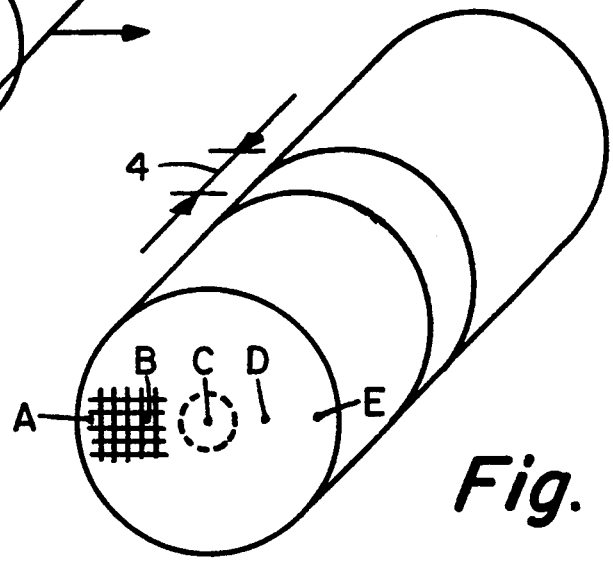
FIG. 2 is a representation of a formed article and points of measurement of temperature.

The five points where temperatures were measured were at the center (C), at opposite sides (A and E) just inside the skin of the formed piece, and mid-way between the center of the piece and the outer edges (points B and D). This scheme of temperature measurement is demonstrated in FIG. 2 where A, B, C, D, and E represent the locations of entry of the thermocouple and range (4) represents the general area where the tip of the thermocouple actually ended up during temperature measurement. Generally, measurements were taken serially from left to right in alphabetical order, therefore, small temperature differences between points A and E may be attributable to the heating or cooling which was taking place during the time of measurement.

The examples below demonstrate the relatively uniform heating which may be accomplished through the inventive use of induction heating for honeycomb structures formed from plastically deformable material comprising electrically conductive particles. Total heating time is in seconds and it should be noted that readings were taken while the induction device was shut off. This means that initial readings were taken, the induction device was turned on for the period of time indicated, the device was then turned off, and temperature readings were taken. It should also be noted that the time periods given indicate cumulative time of application of power through the induction device to the piece being tested. As indicated, the pieces were weighed at each step. Since the pieces were capable of being handled for weighing, it was apparent that substantial stiffening had occurred even early in the experiments. In this case, weight loss is probably attributable to water loss through evaporation. It is assumed that full drying did not occur in experiments in which a constant weight was not obtained for the pieces.

EXAMPLE 1

A frequency of 2.5 MHz was applied at 7.5 kW for this experiment. The results are shown in Table 1.

TABLE 1

| Total heating time (seconds) | 2.5 MHz/7.5 kW temperatures (C.) A | B | C | D | E | weight(g) |
|---|---|---|---|---|---|---|
| 0 | 27 | 26 | 26 | 25 | 26 | 266 |

TABLE 1-continued

| Total heating time (seconds) | 2.5 MHz/7.5 kW temperatures (C.) A | B | C | D | E | weight(g) |
|---|---|---|---|---|---|---|
| 30 | 46 | 44 | 42 | 43 | 43 | 262.9 |
| 120 | 88 | 90 | 99 | 96 | 76 | 260.3 |
| 180 | 83 | 89 | 89 | 88 | 78 | 257.1 |
| 240 | 87 | 91 | 92 | 90 | 84 | 253.3 |
| 300 | 95 | 95 | 88 | 89 | 87 | 250.1 |
| 360 | 97 | 96 | 94 | 94 | 92 | 254.9 |
| 420 | 125 | 96 | 94 | 94 | 114 | 236.6 |

EXAMPLE 2

Another experiment was run on a new formed unit on the same induction device. All conditions were the same except that heating intervals were altered. The results are presented in Table 2 below.

TABLE 2

| total heating time (seconds) | 2.5 MHz/7.5 kW temperatures (C.) A | B | C | D | E | weight(g) |
|---|---|---|---|---|---|---|
| 0 | 25 | 25 | 25 | 25 | 25 | 273.2 |
| 300 | 85 | 92 | 92 | 92 | 90 | 260.7 |
| 360 | 82 | 91 | 93 | 91 | 85 | 256.6 |
| 420 | 99 | 94 | 94 | 92 | 96 | 253.1 |

EXAMPLE 3

Another extruded honeycomb formed from plastically deformable material comprising electrically conductive particulate matter was tested in an induction coil with a 4 inch (10 cm) inside diameter, which was 4.5 inches (11.5 cm) in overall length, and had a total of eight turns. This was run on a 100 kW solid state instrument operating at 6 kHz. The results of this experiment are presented in Table 3 below.

TABLE 3

| total heating time (seconds) | 6 kHz/100 kW temperatures (C.) A | B | C | D | E | weight(g) |
|---|---|---|---|---|---|---|
| 0 | 25 | 25 | 25 | 25 | 25 | 270.4 |
| after tune* | 35 | 35 | 42 | 42 | 38 | — |
| 60 | 64 | 81 | 83 | 80 | 60 | 267.4 |
| 240 | 90 | 98 | 98 | 96 | 84 | 260.3 |

*The piece underwent some heating while the instrument was being tuned.

It should be noted here that relatively even heating did occur in the test piece, as is demonstrated by the above temperature readings, but heating was nowhere near as rapid at this lower frequency, in spite of the more than tenfold increase in power output over the previous two experiments.

EXAMPLE 4

A new extrudate was tested on a 40 kW generator with the same coil which was used in Example 3. The frequency used in this experiment was 200 kHz. The results for this experiment are presented in Table 4 below.

TABLE 4

| total heating time (seconds) | 30 kW/200 kHz approximate temperatures (C.) A | B | C | D | E | weight(g) |
|---|---|---|---|---|---|---|
| 0 | 26 | 25 | 25 | 25 | 25 | 286.8 |
| 30 | 40 | 41 | 41 | 42 | 39 | — |

TABLE 4-continued

| total heating time (seconds) | 30 kW/200 kHz approximate temperatures (C.) A | B | C | D | E | weight(g) |
|---|---|---|---|---|---|---|
| 60 | 49 | 57 | 59 | 58 | 52 | 282.7 |

Again, it may be noted that even heating is occurring, but it is at a lower rate than was seen in the earlier experiments.

EXAMPLE 5

The same machine was used for another experiment but frequency was raised to 375 kHz. Power output was maintained at 30 kW. The results of this experiment are presented in Table 5 below.

TABLE 5

| total heating time (seconds) | 375 kHz/30 kW temperatures (C.) A | B | C | D | E | weight(g) |
|---|---|---|---|---|---|---|
| 0 | 27 | 26 | 26 | 25 | 25 | 269.2 |
| 30 | 91 | 96 | 96 | 94 | 88 | 265.6 |
| 60 | 100 | 102 | 101 | 99 | 92 | 258.5 |
| 75 | 94 | 100 | 99 | 98 | 92 | 253.7 |
| 90 | 96 | 97 | 98 | 97 | 92 | 249.2 |

EXAMPLE 6

This experiment used the same conditions as those which were used in Example 5 but the heating intervals were varied. The results of this experiment are presented in Table 6 below.

TABLE 6

| total heating time (seconds) | 375 kHz/30 kW temperatures (C.) A | B | C | D | E | weight(g) |
|---|---|---|---|---|---|---|
| 0 | 25 | 25 | 25 | 25 | 25 | 284.2 |
| 60 | 95 | 97 | 99 | 98 | 92 | 273.8 |
| 90 | 100 | 102 | 102 | 101 | 98 | 265.5 |
| 120 | 144 | 128 | 119 | 112 | 167 | 257.7 |

Examples 5 and 6 demonstrate clearly the uniform heating until most of the water is removed from the formed article. At that point the heating rate rapidly increases, particularly in areas where there is likely to be less water concentration as is demonstrated by the two outside temperature readings (points A and E) at the 120 second interval in Example 6.

A second series of experiments were conducted at another off-site laboratory using only solid state induction heating equipment which operates at generally lower frequencies than is possible with the tube type equipment which was used for the first six examples. For this series of experiments, articles were formed from plastically deformable material comprising electrically conductive particulate matter in a similar manner to the articles that were formed for the first series of six experiments. Again, cylindrical samples 5 inches (12.7 cm) long with a 3 inch (7.6 cm) diameter having 0.003 inch (0.076 mm) internal walls and 550 cells per square inch (about 85 per $cm^2$) on a transverse cross-section were produced. According to the method described earlier, these pieces were then frozen and transported to the off-site laboratory specializing in the use of solid state induction heating equipment. The induction device being used for this series of experiments was a coil of eight turns with a total length of 6 inches (15.25 cm) and a $3\frac{1}{2}$ inch (8.9 cm) inside diameter. Again, the times indicated are cumulative heating times, the temperatures were taken in the same manner as the previously described series of six experiments, and weights were measured at the time of each set of temperature measurements. It should be noted, however, that for this series of experiments the weights included ceramic setters weighing 172.3 grams, so that actual article weights equal the stated weights minus 172.3 grams.

EXAMPLE 7

This experiment was run at a frequency of 128 kHz and a power output of 25 kW. The results of this experiment are presented in Table 7 below.

TABLE 7

| total heating time (seconds) | 128 kHz/25 kW temperatures (C.) A | B | C | D | E | weight(g) |
|---|---|---|---|---|---|---|
| 0 | 20 | 19 | 19 | 19 | 19 | 489.6 |
| 40 | 54 | 54 | 56 | 57 | 51 | 489.3 |
| 100 | 79 | 87 | 89 | 87 | 73 | 487.4 |
| 160 | 93 | 98 | 97 | 95 | 86 | 483.3 |
| 220 | 95 | 98 | 98 | 96 | 89 | 478.0 |
| 280 | 98 | 100 | 101 | 98 | 94 | 472.7 |
| 340 | 101 | 102 | 100 | 98 | 89 | 466.9 |
| 400 | 88 | 100 | 100 | 97 | 91 | 461.7 |
| 460 | 119 | 127 | 127 | 140 | 130 | 458.6 |

Uniform heating was noted here but it did not occur at a rapid rate.

EXAMPLE 8

In an effort to increase the heating rate, the frequency generator was altered by increasing the capacitance of the tank circuit within the generator. The effect of this modification was to increase the applied frequency to something greater than 128 kHz but the exact frequency is unknown. The results of this experiment are presented in Table 8 below.

TABLE 8

| total heating time (seconds) | 25 kW/>128 kHz temperatures (C.) A | B | C | D | E | weight(g) |
|---|---|---|---|---|---|---|
| 0 | 20 | 19 | 18 | 18 | 19 | 466.8 |
| 40 | 59 | 60 | 61 | 65 | 67 | 465.8 |
| 100 | 91 | 97 | 90 | 94 | 84 | 460.5 |
| 160 | 96 | 100 | 100 | 102 | 89 | 452.5 |
| 220 | 100 | 102 | 100 | 100 | 98 | 444.2 |
| 280 | 113 | 110 | 106 | 110 | 125 | 436.2 |

As this set of experiments demonstrates, uniform heating of formed articles does occur but it occurs at a much lower rate on the lower frequency solid state equipment than that which occurs when using the tube type equipment. This result appears to occur in spite of the approximately equal power outputs of the two devices. The conclusion drawn here is that while lower frequencies will indeed offer the same uniform heating which may be obtained at higher frequencies, better heating efficiencies compared with power output may be obtained at higher frequencies.

Another set of experiments were run using sponge iron as one of the components rather than the carbonyl precipitated iron which was used in the first eight experiments. A new batch of plastically deformable material comprising electrically conductive particulate matter was made in a similar manner as described for the material which was made for the first eight experiments but a different composition was created according to the following recipe:

| Material | Supplier | Weight |
|---|---|---|
| Sponge Iron MH300 (−270 mesh) | Hoeganaes Archer | 27 lbs (12.27 kg) |
| Iron Aluminum Fe/Al 50 | Shieldalloy | 23 lbs (10.45 kg) |
| Zinc (lot 880435) | Fisher Scientific | 0.25 lbs (114 g) |
| Oleic acid (reagent grade) | Mallinckrodt | 0.5 lbs (228 g) |
| Zinc stearate | Witco | 0.5 lbs (228 g) |
| Methyl cellulose | Dow Chemical | 4 lbs (1.82 kg) |
| Cold Deionized Water | — | 7.25 lbs (3.3 kg) |

Following the earlier described processing steps, plastically deformable material comprising electrically conductive particulate matter was produced from this recipe and was extruded through a honeycomb type die which is designed to produce articles having 0.006" (0.15 mm) thick internal walls and 400 cells per square inch (about 62 per $cm^2$) on a transverse cross-section. Articles were produced in a manner similar to that described earlier and were transported in a similar fashion to an off-site laboratory specializing in the use of induction heating equipment. An induction coil made from rectangular copper tubing was attached to a 25 kW solid state induction heating generator operating at 123 kHz. These experiments were run in a fashion similar to those described earlier and again for these two experiments, the weights include ceramic setters weighing 172.3 grams.

EXAMPLE 9

The results of the first such experiment are presented in Table 9 below.

TABLE 9

| total heating time (seconds) | 123 kHz/25 kW temperatures (C.) A | B | C | D | E | weight(g)* |
|---|---|---|---|---|---|---|
| 0 | 18 | 18 | 18 | 96 | 18 | 538.7 |
| 40 | 95 | 97 | 96 | 96 | 92 | 535.7 |
| 100 | 101 | 101 | 100 | 99 | 97 | 518.6 |
| 130 | 122 | 102 | 103 | 102 | 114 | 506.5 |
| 160 | 160 | 134 | 110 | 103 | 200 | 498.0 |

*includes ceramic setters weighing 172.3 grams

EXAMPLE 10

Another article from the same batch of plastically deformable material comprising electrically conductive particulate matter was tested in the same manner as in Example 9 with only the heating interval being varied. The results of this experiment are presented in Table 10 below.

TABLE 10

| total heating time (seconds) | 123 kHz/25 kW temperatures (C.) A | B | C | D | E | weight(g)* |
|---|---|---|---|---|---|---|
| 0 | 25 | 27 | 26 | 29 | 30 | 516.5 |
| 60 | 102 | 101 | 100 | 98 | 95 | 510.3 |
| 90 | 101 | 100 | 99 | 98 | 96 | 501.3 |
| 120 | 117 | 102 | 101 | 100 | 101 | 490.3 |

*includes ceramic setters weighing 172.3 grams

It may be noted from these last two examples that uniform heating of the article placed in proximity to the induction device does occur but it is at a lower rate than the results noted in the earlier set of experiments. This slow rate may result from any of three possibilities, all of which constitute a change from the earlier set of experiments: (1) a lower frequency solid state induction heating generator was used, (2) the articles produced in the experiments for Examples 9 and 10 had internal walls approximately twice as thick as the previous sets of experiments, or (3) the nature of the electrically conductive particulate matter which was a component in the plastically deformable material used for experiments in Examples 9 and 10 was altered by the use of sponge iron which replaced the precipitated carbonyl used in the earlier sets of experiments.

Figure 3:
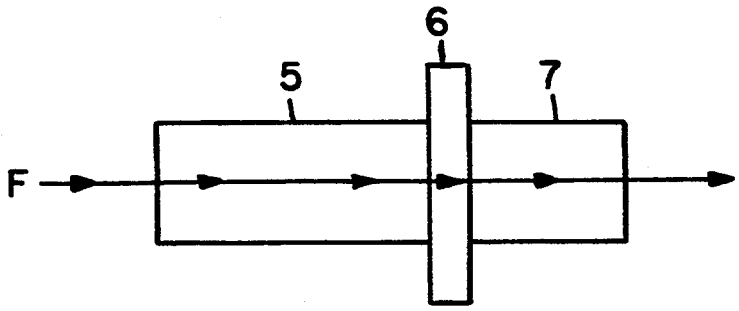
FIG. 3 is a schematic representation of a proposed device which feeds material, forms it, and immediately stiffens the formed article.

As described earlier, due to lack of induction equipment at the facilities where forming occurred, individual pieces were cut from the continuous forming line, frozen and transported to an independent laboratory with induction facilities. Ideally, at least stiffening should occur immediately as the formed material exits the forming member in a continuous fashion. This will allow for easy cutting to proper length and easy handling for further processing at later stages in the production process. This technique is illustrated schematically in FIG. 3 in which material moves in direction (F) through a material delivery means (5), such as an extruder, and into a forming member (6) such as an extrusion die, and immediately into an induction heating means (7), such as a coil. Alternatively, if it were somehow advantageous, it would be possible to locate the heating means (7) downstream some distance along direction (F) from its shown location to allow cutting prior to stiffening but still to accomplish stiffening prior to other handling.

Figure 4:
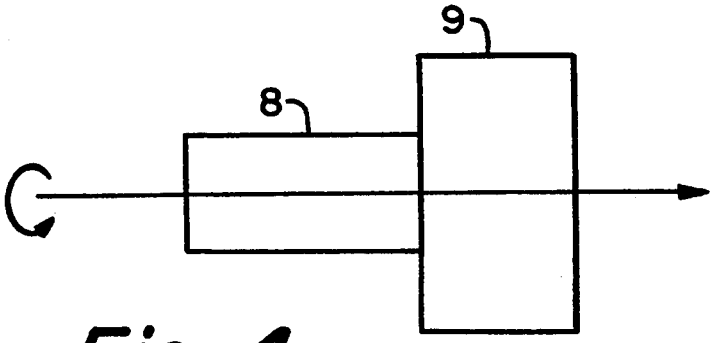
FIG. 4 is a schematic representation of a proposed means to feed material to a combined forming member and stiffening means.

The flexibility of this invention should also allow development of a forming member and induction heating means combination wherein stiffening of very low viscosity plastically deformable materials may be initiated as formation is occurring. This concept is schematically represented in FIG. 4 in which material travels in direction (G) through a delivery means (8), such as an extruder, and into then through a forming member and induction heating means combination (9), such as an extrusion die with an integral induction device. In such a system, at least that portion of the forming member in which heating is desired to take place must be made of a material which is not an induction susceptor. Such a material might be a glass, ceramic, glass-ceramic or plastic material. Such a forming member may be made, for example, by incorporating an induction device within the extrusion die made of non-susceptor material described in U.S. Pat. No. 3,826,603, which is incorporated by reference herein. Such a system, with an induction device positioned within the outlet end of a glass or glass-ceramic die would allow formation of a continuous extremely thin-walled article which can be cut and handled very close to the exit of the forming member and induction means combination since will have been at least stiffened during formation.

With the inherent flexibility of this invention, it will be possible to place induction devices downstream from the operation which at least stiffens the article to accomplish complete drying, curing, burnout, sintering, or any combination of these options.

We claim:

1. A method of uniformly heating plastically deformable material comprising electrically conducting metal particles and a plasticizing agent, the method consisting essentially of:

inducing an electric current or causing hysteresis loss within said material, by using electromagnetic radiation with frequency between about 50 Hertz and about 10 MegaHertz, to cause induction heating of the material.

2. The method of claim 1 wherein said electrically conducting particulate matter is magnetic.

3. The method of claim 2 wherein said thermally gellable organic binder is a polysaccharide.

4. The method of claim 3 wherein said polysaccharide is a cellulose ether.

5. The method of claim 4 wherein said cellulose ether is a methyl cellulose.

6. The method of claim 1, wherein said plasticizing agent comprises a liquid and a polymeric agent having a thermal gel point.

7. The method of claim 1, wherein said inducing step is performed for a time sufficient to dry said material.

8. The method of claim 7 wherein said material comprises water, a methyl cellulose, and sinterable magnetic metallic particulate matter.

9. The method of claim 7 wherein the formed material contains particles selected from the group containing iron, aluminum, and their alloys and the material has been formed into a honeycomb by extrusion.

10. The method of claim 1 wherein the electric current is induced within the material for a time sufficient to stiffen the material into a self-sustaining shape.

11. The method of claim 10 wherein the electric current is induced within the material for a time sufficient to substantially dry the material by volatilizing a liquid in the material to yield a self-sustaining shape.

12. The method of claim 11 wherein the electric current is additionally induced for a time sufficient to cause the burnout of non-inorganic residual materials.

13. The method of claim 11 wherein the electric current is additionally induced for a time sufficient to sinter the remaining inorganic materials.

14. The method of claim 10 wherein the electric current is additionally induced for a time sufficient to cure any curable components.

15. The method of claim 1 wherein said inducing step is applied to said material as it emerges from a forming member.

16. The method of claim 13 wherein said forming member is a honeycomb forming die and said emerging material is in the shape of a honeycomb.

17. The method of claim 1 wherein said inducing step is applied to said material contained in a forming member.

18. The method of claim 17 wherein said material is passed through and out of said forming member.

19. The method of claim 18 wherein said forming member is a honeycomb forming die and said material passed out of said die is in the shape of a honeycomb.

20. The method of claim 1, wherein the plasticizing agent comprises a thermally gellable organic binder.

21. The method of claim 2, wherein the plasticizing agent includes a liquid.

* * * * *